US011236602B2

(12) United States Patent
Al-Rubaii et al.

(10) Patent No.: US 11,236,602 B2
(45) Date of Patent: Feb. 1, 2022

(54) AUTOMATED REAL-TIME TRANSPORT RATIO CALCULATION

(71) Applicant: Saudi Arabian Oil Company, Dhahran (SA)

(72) Inventors: Mohammed Murif Al-Rubaii, Dammam (SA); Abdullah Saleh Hussain Al-Yami, Dhahran (SA); Salem H. Al Gharbi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 150 days.

(21) Appl. No.: 16/681,332

(22) Filed: Nov. 12, 2019

(65) Prior Publication Data

US 2021/0140300 A1 May 13, 2021

(51) Int. Cl.

| | |
|---|---|
| ***E21B 21/08*** | (2006.01) |
| ***E21B 44/06*** | (2006.01) |
| ***E21B 45/00*** | (2006.01) |

(52) U.S. Cl.

CPC ..... *E21B 44/06* (2013.01); *E21B 21/08* (2013.01); *E21B 45/00* (2013.01)

(58) Field of Classification Search

CPC ..... E21B 44/06; E21B 21/08; E21B 45/00; E21B 47/09

See application file for complete search history.

(56) References Cited

U.S. PATENT DOCUMENTS

| | | | | |
|---|---|---|---|---|
| 10,989,046 | B2 * | 4/2021 | Al-Rubaii | E21B 44/00 |
| 2004/0060738 | A1 * | 4/2004 | Hemphill | E21B 47/00 175/40 |
| 2005/0126777 | A1 * | 6/2005 | Rolovic | E21B 47/10 166/255.1 |
| 2013/0085675 | A1 | 4/2013 | Prakash et al. | |

(Continued)

FOREIGN PATENT DOCUMENTS

| | | | |
|---|---|---|---|
| CN | 105626041 A | * | 6/2016 |
| WO | 2017027105 | | 2/2017 |
| WO | 2017209730 | | 7/2017 |

OTHER PUBLICATIONS

PCT International Search Report and Written Opinion in International Appln. No. PCT/US2020/059868, dated Jan. 26, 2021, 13 pages.

(Continued)

*Primary Examiner* — D. Andrews
*Assistant Examiner* — Ronald R Runyan
(74) *Attorney, Agent, or Firm* — Fish & Richardson P.C.

(57) ABSTRACT

Methods, systems, and computer-readable medium to perform operations including determining, in real-time, values of drilling parameters of a drilling system drilling a wellbore. The operations further include calculating, based on the values of the drilling parameters, a cuttings concentration in an annulus of the wellbore (CCA). Further, the operations include calculating, based on the calculated CCA and a mud weight (MW) of a drilling fluid, an effective mud weight ($MW_{eff}$) of the drilling fluid. Yet further, the opera- (Continued)

tions include calculating, based on the effective mud weight, a slip velocity of the cuttings. In addition, the operations include calculating, based on the slip velocity, a transport ratio (TR) of the cuttings.

18 Claims, 11 Drawing Sheets

(56) References Cited

U.S. PATENT DOCUMENTS

| | | | | |
|---|---|---|---|---|
| 2014/0131104 | A1* | 5/2014 | Coley | E21B 47/08 175/48 |
| 2014/0291023 | A1* | 10/2014 | Edbury | E21B 21/08 175/24 |
| 2015/0226049 | A1 | 8/2015 | Frangos et al. | |
| 2017/0044896 | A1 | 2/2017 | Salminen | |
| 2017/0306724 | A1* | 10/2017 | Forstner | E21B 21/08 |
| 2018/0012384 | A1* | 1/2018 | Marland | E21B 47/00 |
| 2019/0316457 | A1 | 10/2019 | Al-Rubaii et al. | |
| 2019/0323328 | A1* | 10/2019 | Rao | E21B 21/08 |
| 2020/0362694 | A1* | 11/2020 | Al-Rubaii | E21B 47/06 |
| 2020/0370381 | A1* | 11/2020 | Al-Rubaii | E21B 47/08 |
| 2020/0371495 | A1* | 11/2020 | Al-Rubaii | E21B 44/00 |

OTHER PUBLICATIONS

Rubaii et al., "A New Robust Approach for Hole Cleaning to Improve Rate of Penetration." SPE Kingdom of Saudi Arabia Annual Technical Symposium and Exhibition. Society of Petroleum Engineers, Aug. 2018, 40 pages.

Baldino et al., "Cuttings settling and slip velocity evaluation in synthetic drilling fluids," 12th Offshore Mediterranean Conference and Exhibition, Offshore Mediterranean Conference, Ravenna, Italy, Mar. 25-27, 2015, 15 pages.

Nazari et al., "Review of Cuttings transport in directional well drilling: systematic approach," SPE 132372, SPE Western Regional Meeting, Society of Petroleum Engineers, Anaheim California, May 27-29, 2010, 15 pages.

Saasen et al., "Autmatic measurement of drilling fluid and drill-cutting properties," SPE 112687, SPE drilling and completion 24.04, Orlando, Florida, Mar. 4-6, 2008, Dec. 2009, 15 pages.

Zhou et al., "Mechanical specific energy versus depth of cut," 46th US Rock Mechanics/Geomechanics Symposium, American Rock Mechanics Association, ARMA 12-622, Chicago, Illinois, Jun. 24-27, 2012, 6 pages.

* cited by examiner

AUTOMATED REAL-TIME TRANSPORT RATIO CALCULATION

The present disclosure relates to wellbore drilling operations.

BACKGROUND

In wellbore drilling operations, a drilling system causes a drill bit to rotate when in contact with a formation. The rotation of the drill bit breaks and fractures the formation to form the wellbore. The portions of the formation that are broken off during drilling are referred to as "formation cuttings." In order to remove the cuttings from the wellbore, the drilling system circulates a drilling fluid (also referred to as "drilling mud" or "mud") to the drill bit. The drilling fluid exits through drill bit nozzles to the bottom of the wellbore. The drilling fluid carries the formation cuttings from the wellbore to the surface. The ability of the drilling fluid to carry the formation cuttings out of the wellbore is referred to as a carrying capacity of the drilling fluid.

SUMMARY

The drilling fluid, by virtue of having a density, exerts a fluid density on the formation in the wellbore. Additionally, as the drilling fluid circulates, friction between the drilling fluid and the wellbore walls causes the drilling fluid to lose some of the pressure provided by a pump (that causes the drilling fluid to flow upward to the surface). The friction pressure that is lost by drilling fluid is absorbed by the formation. The net density exerted on the formation because of the drilling fluid density and the friction pressure absorbed by the formation is referred to as an equivalent circulating density (ECD) of the drilling fluid.

Furthermore, the rate at which the cuttings move toward the surface is referred to as a transport velocity of the cuttings. The transport velocity is calculated as the difference between a velocity of the drilling fluid and a cuttings slip velocity (that is, the settling velocity of the cuttings). In practice, the transport velocity is divided by the velocity of the fluid to determine a transport ratio of the cuttings. Positive values of the transport ratio indicate that the cuttings are being transported to the surface and negative values indicate that the cuttings are accumulating in the borehole. Therefore, the transport ratio is calculated in practice to determine how well the drilling fluid is removing the cuttings from the wellbore.

The present disclosure describes methods and systems for calculating a transport ratio of cuttings in a wellbore in real-time. Additionally, the disclosure describes using the real-time value of the transport ratio to improve wellbore drilling operations. The disclosure also describes a modified transport ratio equation that accounts for factors such as a cuttings weight effect.

Aspects of the subject matter described in this specification may be embodied in methods that include the operations of determining, in real-time, values of drilling parameters of a drilling system drilling a wellbore. The operations further include calculating, based on the values of the drilling parameters, a cuttings concentration in an annulus of the wellbore (CCA). Further, the operations include calculating, based on the calculated CCA and a mud weight (MW) of a drilling fluid, an effective mud weight ($MW_{eff}$) of the drilling fluid. Yet further, the operations include calculating, based on the effective mud weight, a slip velocity of the cuttings.

In addition, the operations include calculating, based on the slip velocity, a transport ratio (TR) of the cuttings.

The previously-described implementation is implementable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In a first aspect, the effective mud weight is calculated using the equation: $(MW_{eff})=(MW*CCA)+MW$.

In a second aspect, the drilling parameters include a rate of penetration (ROP) of a drilling tool of the drilling system, a hole size of the wellbore, and a flow rate (GPM) of the drilling fluid.

In a third aspect, the CCA is calculated using the equation $$CCA = \frac{ROP * HoleSize^2}{810 * GPM}.$$

In a fourth aspect, the transport ratio is calculated using the equation $$TR = \left(1 - \frac{V_{sa} * W_c}{V_{ann} * ECD_{eff}}\right),$$

where $V_{sa}$ is the slip velocity of cuttings, $W_c$ is a cuttings density, $V_{ann}$ is annular velocity, and $ECD_{eff}$ is an effective equivalent circulating density.

In a fifth aspect, where $V_{sa}$ is calculated using the equation $$V_{sa} = \frac{V_{s1} + V_{s2} + V_{sc}}{3},$$

where $V_{s1}$ is a cuttings velocity calculated based on effective viscosity, $V_{s2}$ is a cuttings velocity calculated based on apparent viscosity, and $V_{sc}$ is a cuttings velocity calculated based on the rate of penetration.

In a sixth aspect, controlling, based on the transport ratio, a component of the drilling system to adjust at least one of the drilling parameters.

In a seventh aspect, where controlling, based on the transport ratio, a component of the drilling system to adjust at least one of the drilling parameters includes: determining, based on the transport ratio, a rate of penetration for a drilling tool of the drilling system; and controlling the drilling tool such that the rate of penetration of the drilling tool is less than or equal to the determined rate of penetration.

Particular implementations of the subject matter described in this disclosure can be implemented to realize one or more of the following advantages. First, the technique of using CCA to monitor and control a drilling operation is not used in existing systems. Second, the CCA based techniques for estimating the transport ratio of cuttings is not used in existing systems. Third, the disclosed systems and methods are applicable in both drilling and tripping operations. Fourth, the disclosed systems and methods do not require logs, downhole tools, or wired pipes to perform the disclosed operations. Fifth, the disclosed systems and methods improve various aspects of drilling operations, such as hole cleaning and rate of penetration (ROP) of a drilling tool. These improvements help avoid stuck pipes, alleviate the equivalent circulating density (ECD) effect, reduce torque and drag, and improve transport cuttings in the annulus. Additionally, these improvements lead to cost effectiveness and contribute to well delivery. Sixth, the disclosed system automatically monitors, measures, and directs users to adjust parameters associated with a drilling field to improve drilling operations.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

As described previously, cuttings are portions of the formation that break off when a drilling system is drilling a wellbore. As also described, drilling fluid is used to remove the cuttings from the wellbore by carrying the cuttings to the surface. Many problems may result if the cuttings are not properly removed from the wellbore (for example, not removing the cuttings quickly enough). Example problems that may result include stuck pipe, damage to drilling components, loss of circulation, cuttings accumulation, and uneven drilling rate. Predicting these problems before they occur is difficult. Some existing solutions use drilling models to predict the occurrence of drilling problems. For example, the solutions use the drilling models to calculate estimated values of drilling parameters (for example, transport ratio of cuttings) that are be used to predict a drilling problem. However, these solutions do not account for real-time values of drilling parameters, and therefore, are often inaccurate.

Disclosed are methods and systems for calculating a transport ratio of cuttings in real-time. In an implementation, the transport ratio calculation is derived based on a real-time calculation of a cuttings concentration in the annulus (CCA). The CCA, which is calculated using real-time sensor data, is used to calculate the real-time transport ratio. Specifically, the real-time transport ratio is calculated using an equation that accounts for dynamic factors that affect the transport ratio, such as effective mud weight, equivalent cuttings density (ECD), and cuttings diameter. As such, the disclosed real-time transport ratio equation provides a more accurate value of the transport ratio than existing equations. Furthermore, because the calculated transport ratio is a real-time value, monitoring the transport ratio allows a drilling system to make informed decisions whether to adjust drilling parameters to improve a drilling operation.

Figure 1:
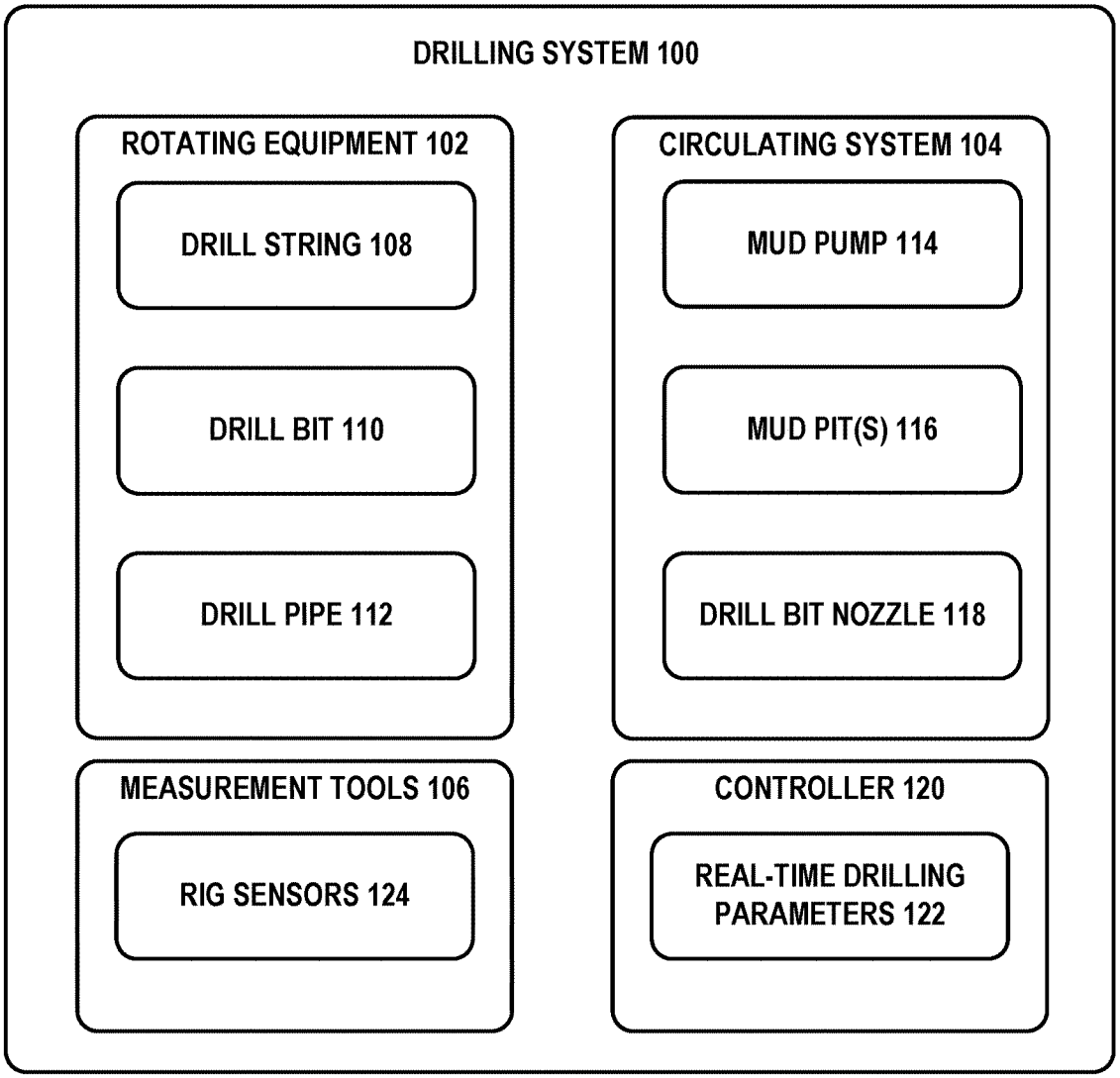
FIG. 1 is a block diagram of an example drilling system, according to some implementations of the present disclosure.

FIG. 1 is a block diagram of an example drilling system 100, according to some implementations. The drilling system 100, which can be used for drilling wellbores, includes rotating equipment 102, circulating system 104, measurement tools 106, and controller 120. The rotating equipment 102, which is responsible for rotary drilling, includes drill string 108, drill bit 110, and drill pipe 112. The circulating system 104, which is responsible for the circulation of drilling fluid, includes mud pump 114, mud pit(s) 116, and drill bit nozzle 118. The measurement tools 106 include sensors, tools, and devices that are configured to gather real-time data associated with the drilling operation. Additionally, the measurement tools 106 include tools configured for measurement while drilling (MWD), logging while drilling (LWD), or both. The controller 120 is a computer system (for example, computer system 400 shown in FIG. 4) that is configured to control one or more components of the drilling system 100. Additionally, the controller 120 is configured to calculate real-time drilling parameters 122, perhaps using real-time data gathered by the measurement tools 106.

To drill a wellbore, the drilling system 100 lowers the drill bit 110, which is attached to the drill string 108, until the drill bit 110 makes contact with a formation. Once in contact, the drill bit 110 rotates to break and fracture the formation, thereby forming the wellbore. As the rotating equipment 102 drills the wellbore, the mud pump 114 withdraws drilling fluid from the mud pit(s) 116 and pumps the drilling fluid down the drill string 108 through the drill bit nozzles 118 that are located on or proximate to the drill bit 110. The drilling fluid flows to the bottom of the wellbore and upward to the surface via an annulus formed between the drill string 108 and the walls of the wellbore. When flowing to the surface, the drilling fluid carries cuttings that are fractured by the rotating drill bit 110. At the surface, the circulating system 104 filters the cuttings from the drilling fluid and pumps the drilling fluid back down to the bottom of the wellbore to repeat the process.

During the drilling operation, the measurement tools 106 collect data associated with the drilling operation. In an implementation, rig sensors 124 may gather real-time surface data. The rig sensors 124 include depth-tracking sensors (for example, a hole depth sensor), flow-in tracking sensors (for example, to measure flow-in from mud pump 114), pressure-tracking sensors, flow-out tracking sensors, drill-monitor sensors (for example, bit depth sensors, bit-rotating hours sensor, torque sensor, and weight-on-bit sensor), pit-monitor sensors (for example, pit volume sensor, pump stroke sensor, and trip tank sensor), and gas-detection sensors. The real-time data gathered by the measurement tools 106 are be used to make informed drilling and geological decisions (for example, manually, autonomously, or both).

In an embodiment, the controller 120 uses the real-time data to calculate real-time drilling parameters 122. Calculating the real-time drilling parameters 122 allows the drilling system 100 to characterize the drilling operation. For example, the real-time drilling parameters 122 provide information indicative of mud logging, cuttings analyses, wellbore conditions, formation conditions, and geology. Such information provides insights about the drilling operation and is used to make informed drilling or geological decisions. Real-time monitoring of the drilling parameters also allows the controller 120 to predict the occurrence of drilling problems. In response to predicting a drilling problem, the controller 120 takes remedial action to mitigate or avoid the drilling problem.

In an implementation, the controller 120 uses the real-time data to calculate a cuttings concentration in an annulus (CCA) of the wellbore. The drilling parameters that are used to calculate the CCA include a rate of penetration (ROP) of the drill bit 110, a hole size of the wellbore, and a flow rate of the mud pump 114. In an example, the CCA is calculated using Equation (1):

$$CCA = \frac{ROP * HoleSize^2}{810 * GPM}. \tag{1}$$

In Equation (1), "HoleSize" is a diameter of the wellbore in feet (ft), ROP is a rate of penetration of a drill bit in feet/hour (ft/hr), and GPM is a flow rate of the mud pump 114 in gallons per minute (gal/min). The controller 120 uses the CCA to calculate an effective drilling fluid density ($MW_{eff}$). In an example, the controller 120 uses Equation (2) to calculate the real-time effective drilling fluid density:

$$MW_{eff}=(MW*CCA)+MW. \tag{2}$$

In Equation (2), $MW_{eff}$ is the effective drilling fluid density in pounds per gallon (lb/gal) and MW is the static drilling fluid density (that is, the drilling fluid density without any cuttings). As shown by Equation (2), the effective drilling fluid density accounts for the static drilling fluid density and the cuttings concentration.

Furthermore, the controller 120 uses the real-time effective drilling fluid density to calculate an equivalent circulating density (ECD). Specifically, the controller 120 calculates the ECD using Equation (3):

$$ECD = MWeff + \left(\left(\left(\frac{0.085}{OH - DP}\right)\left(YP + \frac{PV * V_{ann}}{300 * (OH - DP)}\right)\right)7.481\right). \tag{3}$$

In Equation (3), OH is an open-hole diameter of the wellbore in inches (in), DP is a diameter of a drill pipe in inches, YP is a yield point of the drilling fluid in lb/100 $ft^2$, PV is a plastic viscosity of the drilling fluid in centiPoise (CP), and $V_{ann}$ is an annular velocity of the drilling fluid in feet/minute (ft/min). In an implementation, the controller 120 calculates $V_{ann}$ using Equation (4):

$$V_{ann} = \frac{24.5 * GPM}{Hole(Size)^2 - OD_{pipe^2}}. \tag{4}$$

In Equation (4), $OD_{pipe}$ is an outer diameter of a drill-pipe in inches.

Further, the controller 120 calculates an effective equivalent circulating density ($ECD_{eff}$) based on the real-time ECD and CCA. Specifically, the controller 120 calculates the effective equivalent circulating density using Equation (5):

$$ECD_{eff}=MW*CCA+ECD. \tag{5}$$

As shown by Equation (5), the effective equivalent circulating density accounts for the equivalent circulating density and the cuttings concentration. In particular, the effective circulating density takes into account the effective weight of cuttings generated during drilling and annular pressure loss between open hole diameter and drill pipe diameter. The equivalent circulating density, on the other hand, accounts for annular presser loss between open hole diameter and drilling pipe diameter.

Additionally, the controller 120 calculates a cuttings rise velocity ($V_{er}$) using Equation (6):

$$V_{cr} = \frac{60}{\left(1 - \left(\frac{OD_{pipe}}{HoleSize}\right)^2\right) * \left(0.64 + \frac{18.16}{ROP}\right)}. \tag{6}$$

The cuttings rise velocity indicates an amount of generated cuttings that are lifted with the mud due to the effect of the ROP. The controller 120 also calculates an apparent viscosity of the drilling fluid using Equation (7):

$$M_{app} = \frac{2.4 * V_{ann}}{OH - OD_{pipe}} * \left(\frac{2n + 1}{3n}\right)^n \left(\frac{200 * K * (OH - OD_{pipe})}{V_{ann}}\right). \tag{7}$$

In Equation (7), K is a consistency factor and n is a flow behavior index of the drilling fluid. Further, the controller 120 calculates an effective viscosity of the drilling fluid ($M_{eff}$) using Equation (8):

$$M_{eff} = PV + 300 * YP * \frac{dc}{V_{ann}}. \tag{8}$$

In Equation (8), dc is a drilling diameter in inches and is calculated using Equation (9):

$$dc = 0.2\left(\frac{ROP}{RPM}\right). \tag{9}$$

In Equation (9), RPM is a rate of rotation of a drill bit in rotations per minute (RPM).

In an implementation, the controller 120 also calculates a transport ratio of the drilling fluid. As previously described, the transport ratio is calculated in practice as a ratio of the transport velocity to the velocity of the drilling fluid. However, this calculation is deficient because it does not consider many of the factors that affect the transport ratio (for example, cuttings density). In an implementation, the controller 120 calculates the transport ratio using Equation (10):

$$TR = \left(1 - \frac{V_{sa} * W_c}{V_{ann} * ECD_{eff}}\right). \tag{10}$$

In Equation (10), $V_{sa}$ is the slip velocity of cuttings (that accounts for the effect of mud weight) in ft/min and $W_c$ is a cuttings density in lb/gal. The cuttings density is calculated using Equation (11):

$$W_c = \frac{(MW * CCA + MW) - (1 - CCA) * MW}{CCA}. \tag{11}$$

Furthermore, the slip velocity of the cuttings (with the effect of mud weight) is calculated using Equation (12):

$$V_{sa} = \frac{V_{s1} + V_{s2} + V_{sc}}{3}. \tag{12}$$

In Equation (12), $V_{s1}$ is a cuttings velocity calculated based on effective viscosity, $V_{s2}$ is a cuttings velocity calculated based on apparent viscosity, and $V_{sc}$ is a cuttings velocity calculated based on a rate of penetration. In an implementation, $V_{s1}$, $V_{s2}$, and $V_{sc}$ are calculated using Equations (13), (14), and (15), respectively:

$$V_{s1} = 0.45 * \left(\frac{M_{eff}}{(MW * dc)}\right) * \left(\left(\frac{36800 * MW * dc^3 * (W_c - MW)}{M_{eff}^2}\right) + 1\right)^{0.5} - 1\Bigg). \tag{13}$$

$$V_{s2} = \left(\frac{175 * dc * (Wc - MW)^{0.667}}{MW^{0.333} * M_{app}^{0.333}}\right). \tag{14}$$

$$V_{sc} = \frac{24.5\ GPM}{OH^2 - DP^2} - \frac{60}{\left(1 - \left(\frac{OD_{pipe}}{HoleSize}\right)^2\right)\left(0.64 + \frac{18.16}{ROP}\right)}. \tag{15}$$

As shown by Equations (12)-(15), the slip velocity is calculated as the average of three values of cuttings velocity, each of which is calculated using a respective equation. As also shown by Equations (12)-(15), the slip velocity accounts for real-time drilling parameters, such as density of cuttings, drilling fluid weight, and rheology of the drilling fluid. Accordingly, the transport ratio of Equation (10) accounts for real-time drilling parameters, such as density of cuttings, drilling fluid weight, and the rheology of the drilling fluid. Because these drilling parameters affect the actual transport ratio, the transport ratio of Equation (10) is more accurate than traditional equations for calculating transport ratio.

In an implementation, the controller 120 uses the transport ratio to determine information about the drilling operation. For example, the controller 120 uses the transport ratio to determine a hole cleaning efficiency. That is, the controller 120 may use the real-time transport ratio to determine how well cuttings are being removed from the wellbore. From the derived information about the drilling operation, the controller 120 determines to make one or more adjustments to the operation, perhaps in response to changing downhole conditions or predicting the occurrence of a drilling problem. The adjustments may be made to surface properties, mechanical parameters (for example, ROP, flow rate, pipe-rotation speed, and tripping speed), or both. In response to making the determination to make one or more adjustments, the controller 120 adjusts the operating parameters of one or more components of the drilling system 100 to adjust the surface properties, the mechanical parameters, or both.

In an example, based on the transport ratio, the controller 120 determines a maximum rate of penetration for the drill bit 110. More specifically, based on the transport ratio, the controller 120 determines an efficiency of cuttings removal from the wellbore. Based on that efficiency, the controller 120 calculates a maximum rate of penetration that would not result in drilling problems, such as stuck pipe and cuttings accumulation. The controller 120 then controls the rate of penetration based on the maximum rate. For example, the controller 120 determines the rate of penetration to be a threshold percentage less than the maximum penetration rate. Controlling the rate of penetration based on the transport ratio allows the drilling system 100 to: (i) avoid fracturing the formation while drilling, (ii) ensure a smooth drilling rate, and (iii) avoid or mitigate stuck pipe incidents.

In another example, based on the value of the transport ratio, the controller 120 adjusts the value of the transport ratio to a new desired value. In one implementation, the controller 120 adjusts the transport ratio by controlling the mud pump 114 to increase or decrease the volume of drilling fluid pumped into the wellbore, thereby increasing or decreasing the effective drilling fluid density.

Figure 2A:
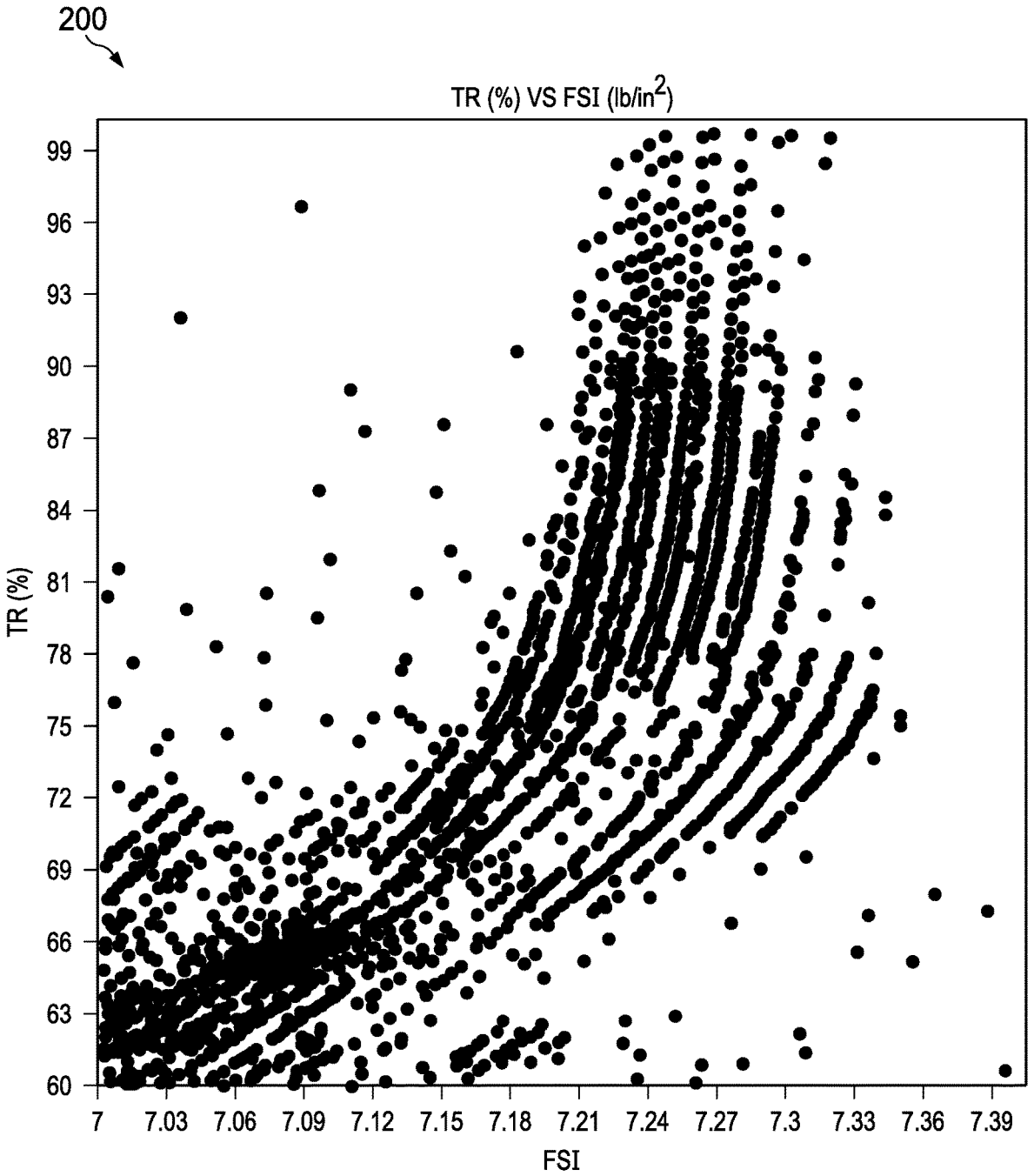
FIG. 2A is a graph of transport ratio versus force, according to some implementations of the present disclosure.
Figure 2B:
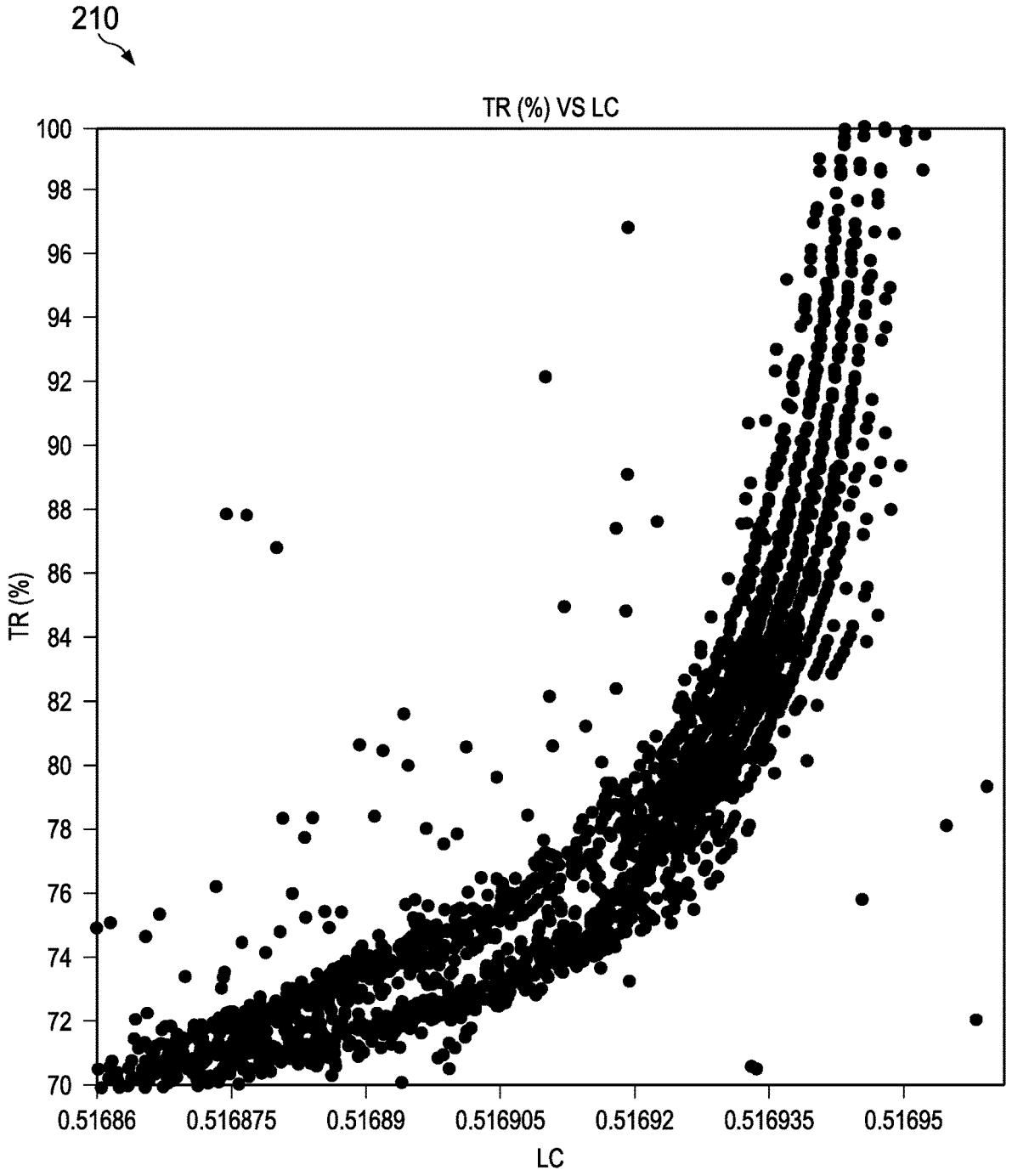
FIG. 2B is a graph of transport ratio versus lifting capacity factor, according to some implementations of the present disclosure.
Figure 2C:
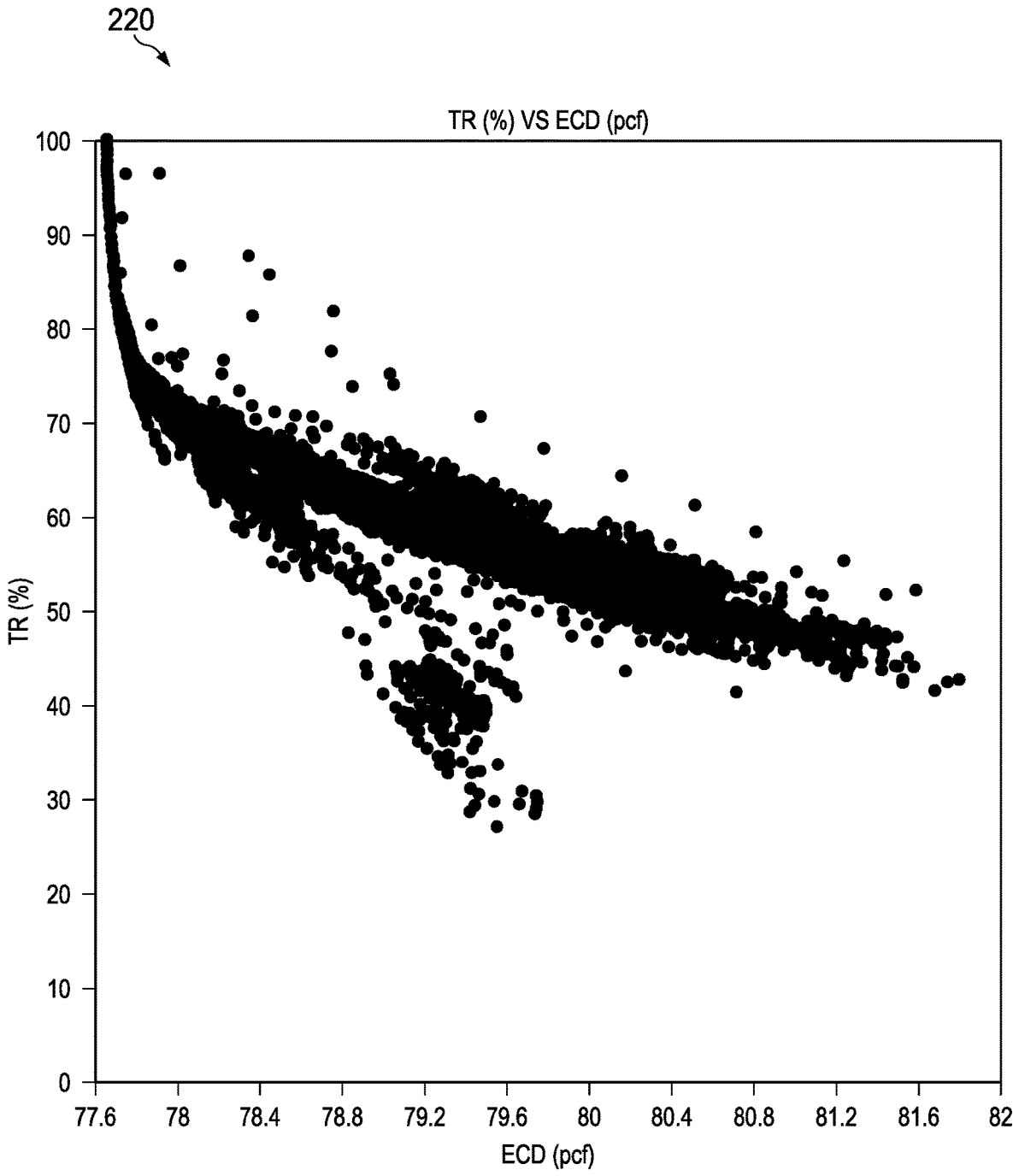
FIG. 2C is a graph of transport ratio versus equivalent circulating density, according to some implementations of the present disclosure.
Figure 2D:
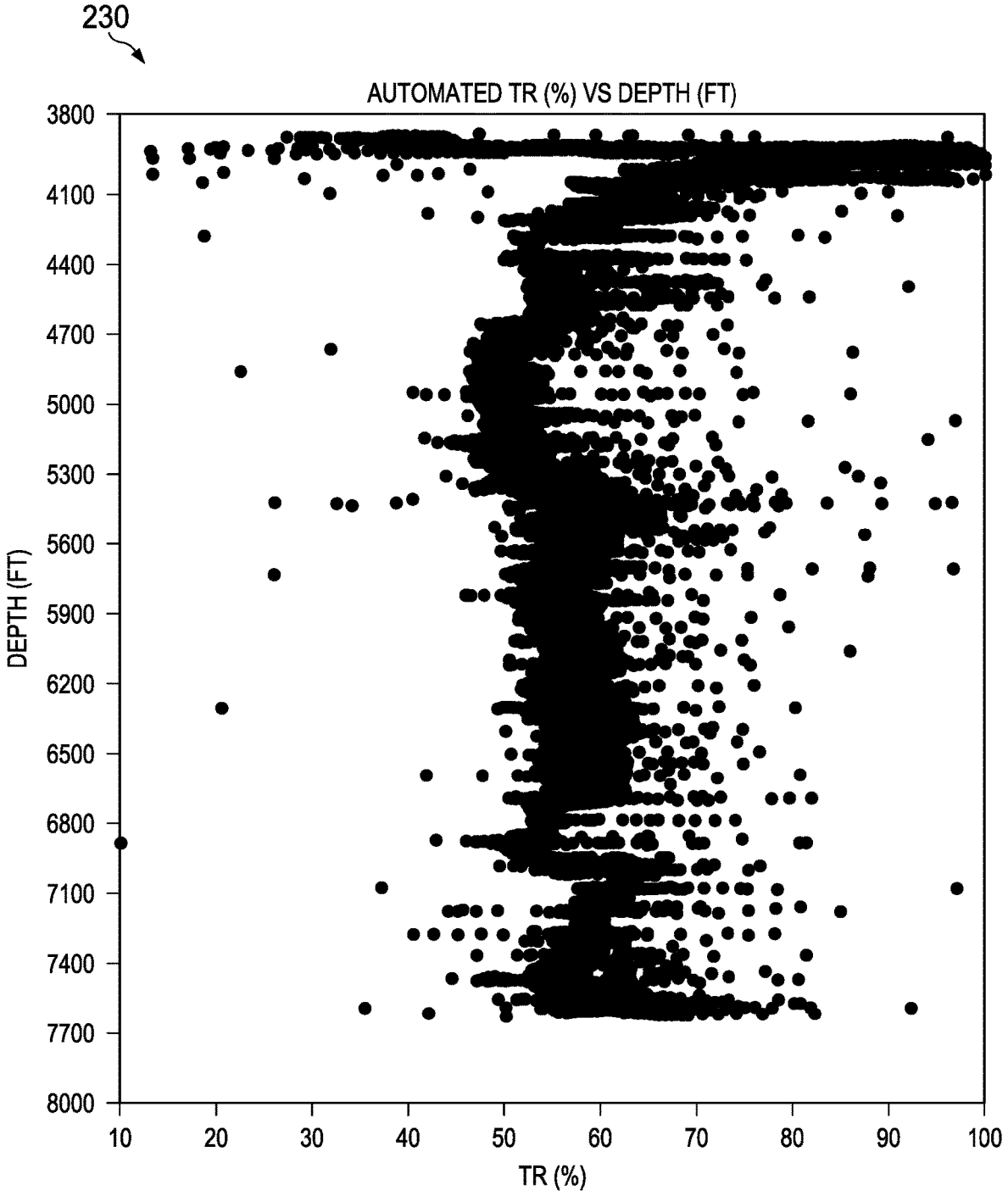
FIG. 2D is a graph of transport ratio versus depth, according to some implementations of the present disclosure.
Figure 2E:
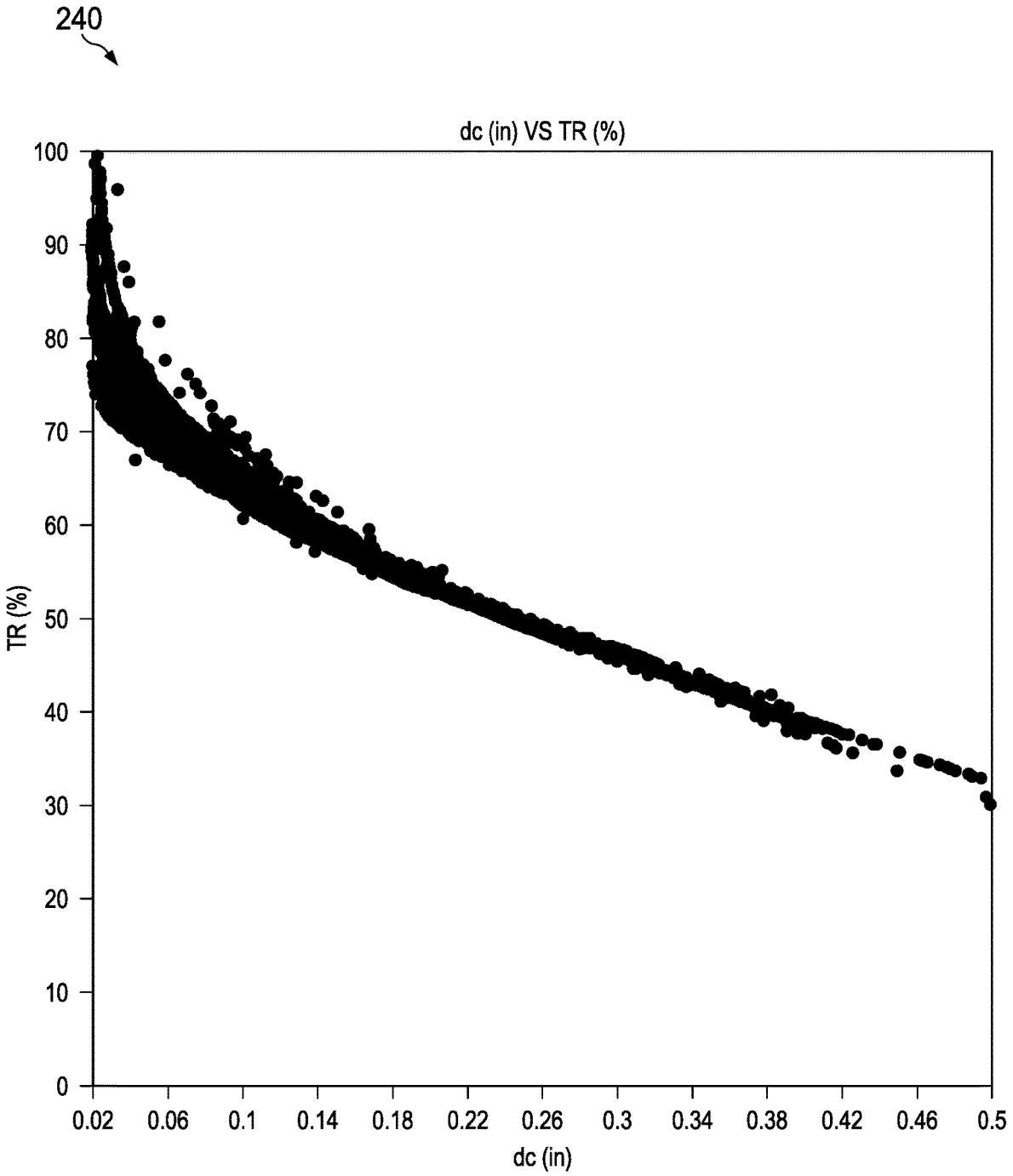
FIG. 2E is a graph of cutting diameter versus transport ratio, according to some implementations of the present disclosure.
Figure 2F:
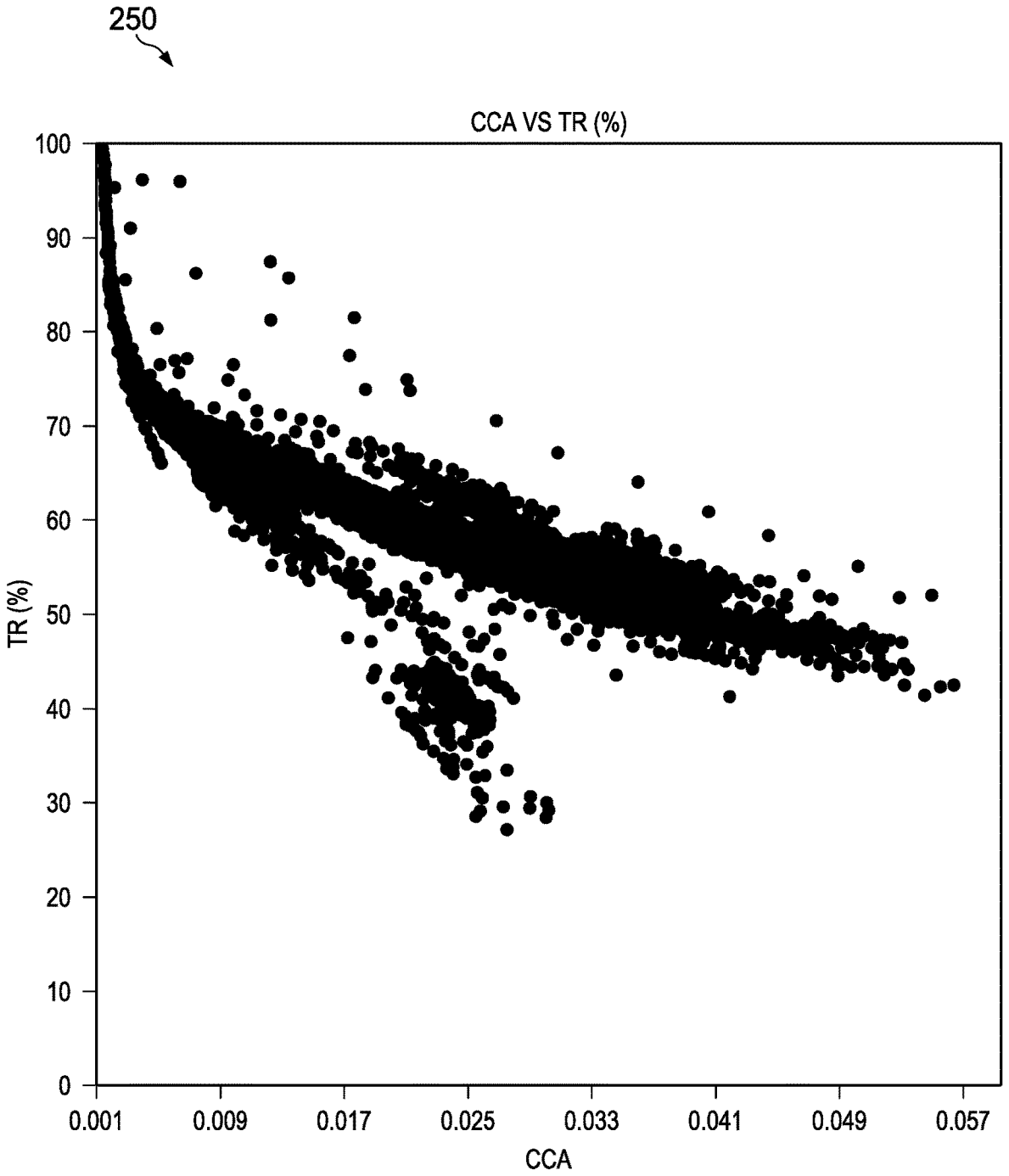
FIG. 2F is a graph of cuttings concentration in the annulus versus transport ratio, according to some implementations of the present disclosure.
Figure 2G:
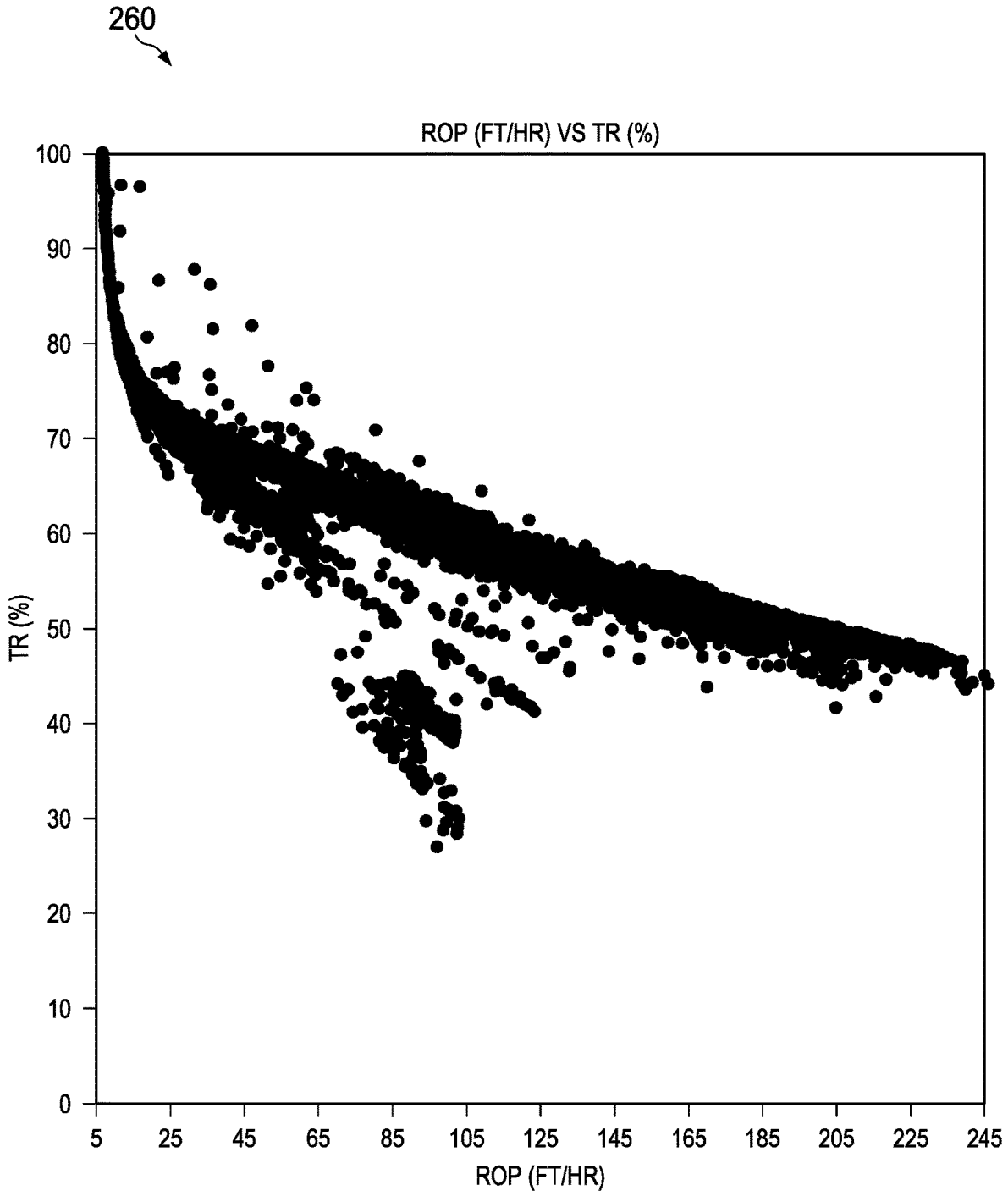
FIG. 2G is a graph of rate of penetration versus transport ratio, according to some implementations of the present disclosure.
Figure 2H:
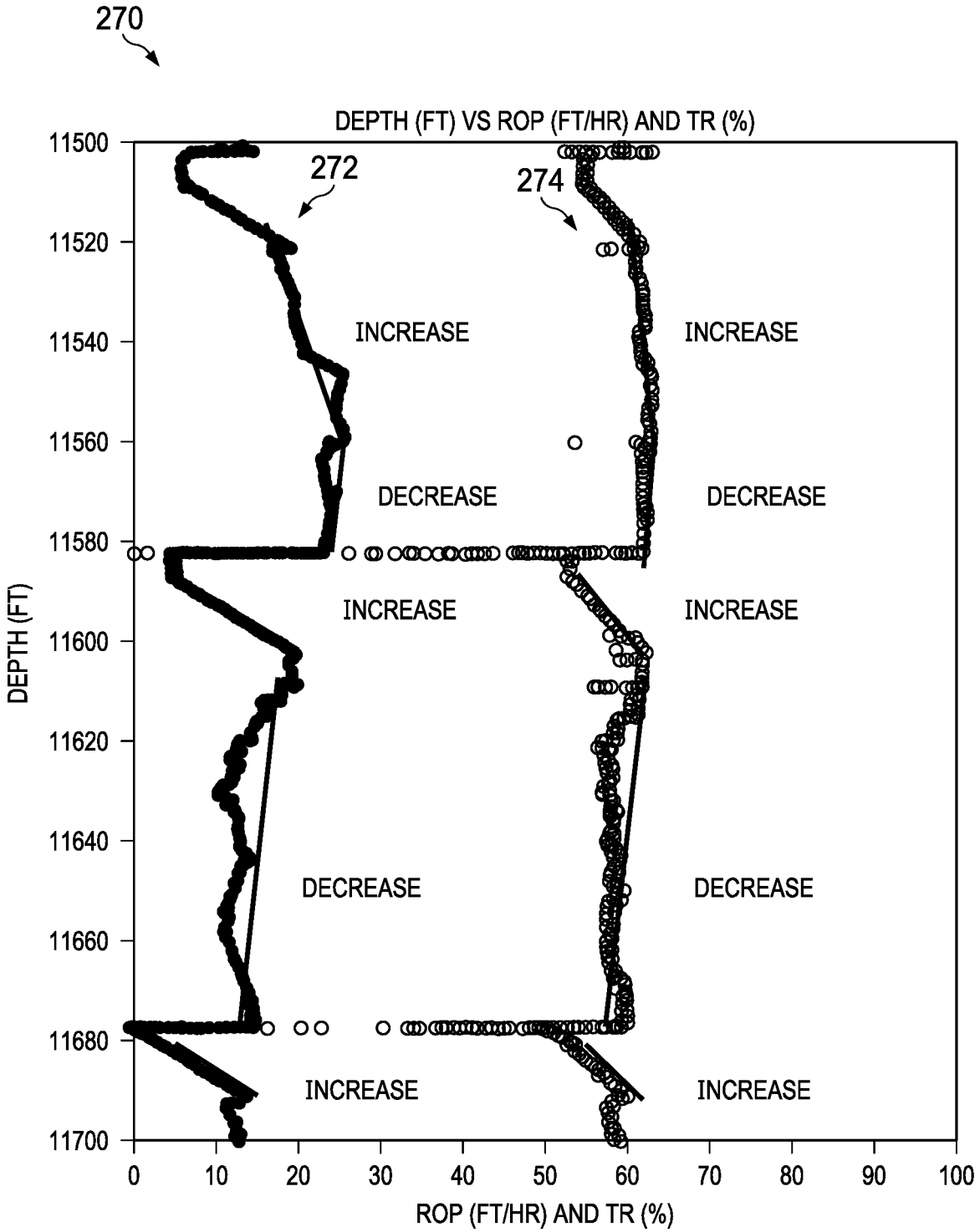
FIG. 2H is a graph of depth versus rate of penetration and transport ratio, according to some implementations of the present disclosure.
Figure 3:
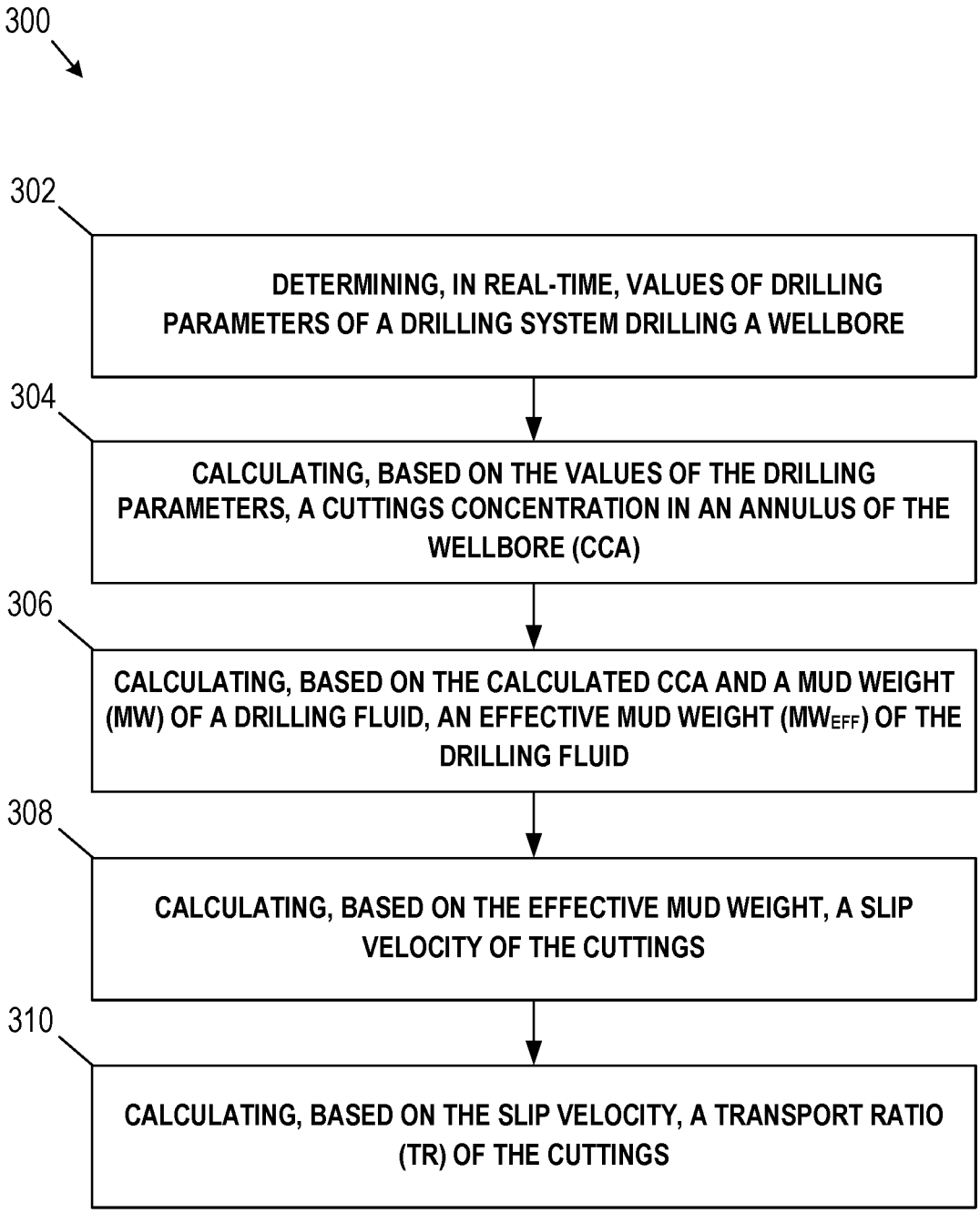
FIG. 3 is a flowchart of an example method for calculating transport ratio of cuttings in real-time, according to some implementations of the present disclosure.

FIGS. 2A, 2B, 2C, 2D, 2E, 2F, 2G, and 2H are graphs that each depict a respective relationship between transport ratio and at least one other drilling parameter when implementing the disclosed methods (for example, method 300 of FIG. 3). The respective relationships indicate how the at least one other drilling parameter improves as a result of increasing the transport ratio by implementing the disclosed methods.

FIG. 2A illustrates a graph 200 of transport ratio versus force per square inch (FSI) of the drilling bit. The transport ratio is represented as a percentage and is indicative of the percentage of cuttings that are removed from the wellbore during drilling. The force per square inch represents the force per square inch exerted by a drill bit onto a formation. As shown by the graph 200, increasing the transport ratio percentage by implementing the disclosed methods allows the FSI of the drilling bit to be increased. Increasing the FSI of the drilling bit in turn improves well drilling performance.

FIG. 2B illustrates a graph 210 of transport ratio versus lifting capacity (LC) percentage. The lifting capacity of the drilling fluid represents the ability of drilling fluid to carry cuttings to the surface. As shown by graph 210, increasing the transport ratio by implementing the disclosed methods results in a greater LC value. A greater LC value indicates that the drilling fluid is capable of lifting more of the generated drilling cuttings.

FIG. 2C illustrates a graph 220 of transport ratio percentage versus equivalent circulating density (ECD). As shown by the graph 220, increasing the transport ratio by implementing the disclosed methods decreases the ECD in the annulus. A decrease in ECD corresponds to a decrease in the accumulation of cuttings in the annulus.

FIG. 2D illustrates a graph 230 of transport ratio percentage versus wellbore depth. In graph 230, the real-time transport ratio indicates how efficiently the drilling fluid transports the drilling cuttings while drilling. Specifically, a reduction in transport ratio indicates that less drilling cuttings are being transported from the bottom of the hole to the surface. In order to avoid accumulation of the drilling cuttings, the ROP of the drilling tool has to be controlled. Conversely, an increase in transport ratio indicates that the drilling fluid is capable of transporting the drilling cuttings to the surface. This efficient real-time evaluation of hole cleaning while drilling facilitates quicker intervention than otherwise possible. Thus, increasing the transport ratio by implementing the disclosed methods improves intervention time.

FIG. 2E illustrates a graph 240 of drilling diameter (dc) versus transport ratio percentage. Specifically, graph 240 illustrates a real-time cuttings size of drilling cuttings verses the real-time transport ratio. The real-time cuttings size is a function of the ROP. As shown in graph 240, bigger size drilling cuttings affect the transport ratio. Thus, graph 240 is used to determine an optimum or proper ROP to maintain optimum well drilling performance FIG. 2F illustrates a graph 250 of CCA versus transport ratio. Graph 250 shows that increasing the transport ratio decreases the cuttings concentration in the annulus. Therefore, increasing the transport ratio improves hole cleaning, which, in turn, optimizes the rate of penetration.

FIG. 2G illustrates a graph 260 of ROP versus transport ratio. Graph 260 illustrates that increasing the ROP will decrease the real-time transport ratio due to accumulation of drilling cuttings that result from the increased ROP.

FIG. 2H illustrates a graph 270 of depth versus ROP and transport ratio. In graph 270, line 272 represents the ROP and line 274 represents the transport ratio. Graph 270 shows that optimizing the transport ratio will allow a greater value of ROP. Specifically, increasing the transport ratio by implementing the disclosed methods increases the allowable ROP. In an example, as a result of implementing the disclosed methods, the transport ration can be increased automatically by the drilling system or manually by an operator, thereby increasing the allowable ROP. And increasing the allowable ROP improves the well drilling performance.

FIG. 3 is a flowchart of an example method 300 for calculating a real-time transport cuttings ratio, according to some implementations. For clarity of presentation, the description that follows generally describes method 300 in the context of the other figures in this description. However, it will be understood that method 300 can be performed, for example, by any suitable system, environment, software, and hardware, or a combination of systems, environments, software, and hardware, as appropriate. In some implementations, various steps of method 300 can be run in parallel, in combination, in loops, or in any order.

Method 300 begins at step 302, which involves determining, in real-time, values of drilling parameters of a drilling system drilling a wellbore. The term "real-time" can correspond to events that occur within a specified period of time, such as within one minute, within one second, or within milliseconds. In some implementations, some of the drilling parameters, such as ROP, hole size, and GPM can be automatically extracted from data gathered by rig sensors. In some implementations, other drilling parameters, such as the static density of the drilling fluid, annular velocity, and rheology factors, can automatically be extracted from received logs (for example, a rheology log). In other implementations, the drilling parameters are determined from one or more additional sources such as measuring while drilling (MWD) tools, logging while drilling (LWD) tools, and daily drilling reports (also referred to as "morning reports").

At step 304, method 300 involves calculating, based on the values of the drilling parameters, a cuttings concentration in an annulus of the wellbore (CCA). In an implementation, the drilling parameters that are used to calculate the CCA include a rate of penetration (ROP) of a drilling tool, a hole size of the wellbore, and a mud pump flow rate (GPM). In an example, the CCA is calculated using Equation (1).

At step 306, method 300 involves calculating, based on the calculated CCA and a mud weight (MW) of a drilling fluid, an effective mud weight ($MW_{eff}$) of the drilling fluid. In an example, the effective drilling fluid density is calculated using Equation (2).

At step 308, method 300 involves using the effective mud weight to calculate a slip velocity of the cuttings. In an example, the slip velocity is calculated using Equation (12).

At step 310, method 300 involves calculating, based on the slip velocity, a transport ratio (TR) of the cuttings. In an example, the transport ratio is calculated using Equation (10).

The example method 300 shown in FIG. 3 can be modified or reconfigured to include additional, fewer, or different steps (not shown in FIG. 3), which can be performed in the order shown or in a different order. As an example, after step 310, the method 300 can include controlling, based on the transport ratio, a component of the drilling system to adjust at least one of the drilling parameters. As other examples, the method 300 can include determining, based on the transport ratio, a rate of penetration for a drilling tool of the drilling system and controlling the drilling tool such that the rate of penetration of the drilling tool is less than or equal to the determined rate of penetration.

Figure 4:
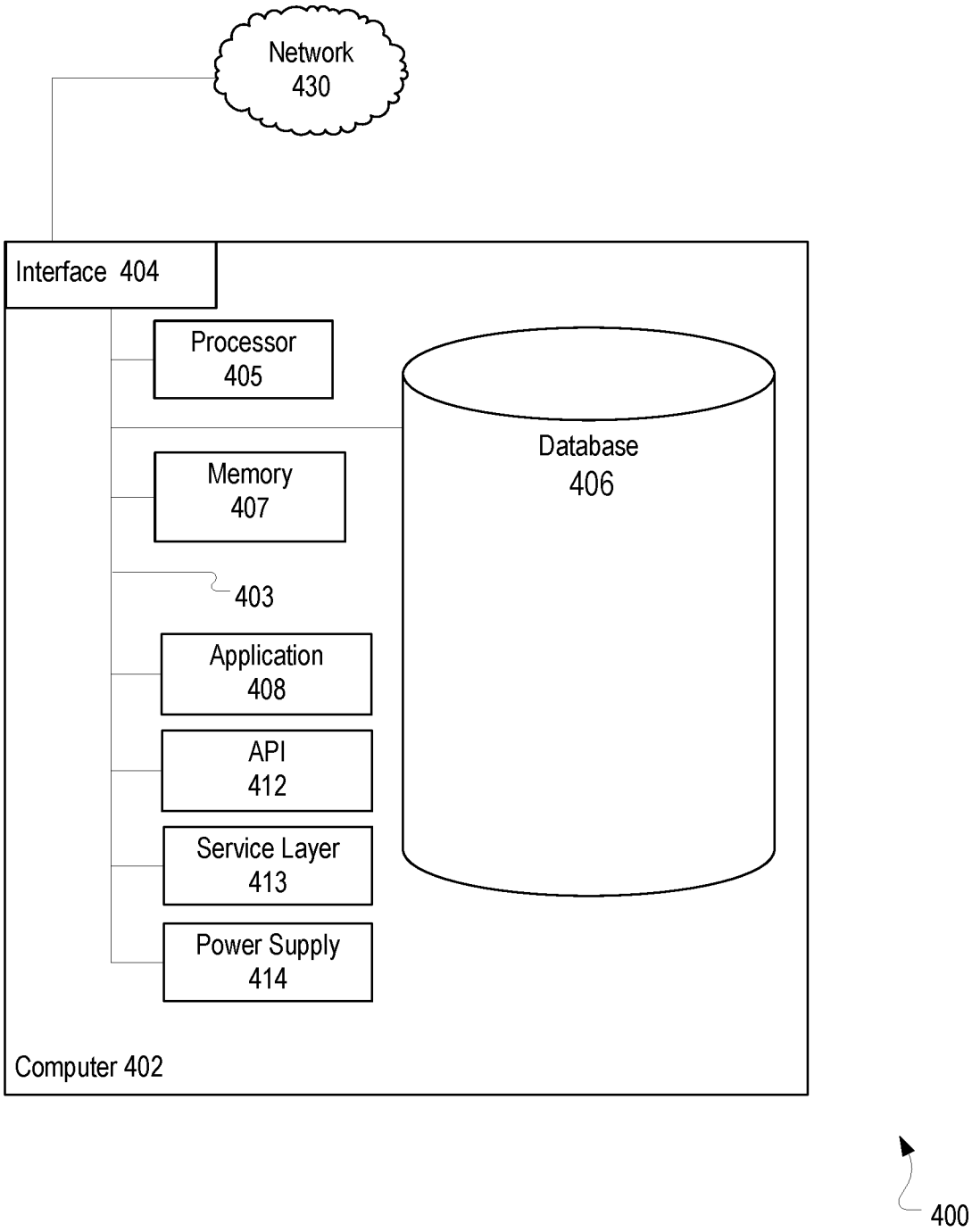
FIG. 4 is a block diagram of an example computer system used to provide computational functionalities associated with described algorithms, methods, functions, processes, flows, and procedures as described in the present disclosure, according to some implementations of the present disclosure.

FIG. 4 is a block diagram of an example computer system 400 used to provide computational functionalities associated with described algorithms, methods, functions, processes, flows, and procedures described in the present disclosure, according to some implementations of the present disclosure. The illustrated computer 402 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 402 can include input devices such as keypads, keyboards, and touch screens that can accept user information. In addition, the computer 402 can include output devices that can convey information associated with the operation of the computer 402. The information can include digital data, visual data, audio information, or a combination of information. The information can be presented in a graphical user interface (UI) (or GUI).

The computer 402 can serve in a role as a client, a network component, a server, a database, a persistency, or components of a computer system for performing the subject matter described in the present disclosure. The illustrated computer 402 is communicably coupled with a network 430. In some implementations, one or more components of the computer 402 can be configured to operate within different environments, including cloud-computing-based environments, local environments, global environments, and combinations of environments.

At a high level, the computer 402 is an electronic computing device operable to receive, transmit, process, store, and manage data and information associated with the described subject matter. According to some implementations, the computer 402 can also include, or be communicably coupled with, an application server, an email server, a web server, a caching server, a streaming data server, or a combination of servers.

The computer 402 can receive requests over network 430 from a client application (for example, executing on another computer 402). The computer 402 can respond to the received requests by processing the received requests using software applications. Requests can also be sent to the computer 402 from internal users (for example, from a command console), external (or third) parties, automated applications, entities, individuals, systems, and computers.

Each of the components of the computer 402 can communicate using a system bus 403. In some implementations, any or all of the components of the computer 402, including hardware or software components, can interface with each other or the interface 404 (or a combination of both), over the system bus 403. Interfaces can use an application programming interface (API) 412, a service layer 413, or a combination of the API 412 and service layer 413. The API 412 can include specifications for routines, data structures, and object classes. The API 412 can be either computer-language independent or dependent. The API 412 can refer to a complete interface, a single function, or a set of APIs.

The service layer 413 can provide software services to the computer 402 and other components (whether illustrated or not) that are communicably coupled to the computer 402. The functionality of the computer 402 can be accessible for all service consumers using this service layer 413. Software services, such as those provided by the service layer 413, can provide reusable, defined functionalities through a defined interface. For example, the interface can be software written in JAVA, C++, or a language providing data in extensible markup language (XML) format. While illustrated as an integrated component of the computer 402, in alternative implementations, the API 412 or the service layer 413 can be stand-alone components in relation to other components of the computer 402 and other components communicably coupled to the computer 402. Moreover, any or all parts of the API 412 or the service layer 413 can be implemented as child or sub-modules of another software module, enterprise application, or hardware module without departing from the scope of the present disclosure.

The computer 402 includes an interface 404. Although illustrated as a single interface 404 in FIG. 4, two or more interfaces 404 can be used according to particular needs, desires, or particular implementations of the computer 402 and the described functionality. The interface 404 can be used by the computer 402 for communicating with other systems that are connected to the network 430 (whether illustrated or not) in a distributed environment. Generally, the interface 404 can include, or be implemented using, logic encoded in software or hardware (or a combination of software and hardware) operable to communicate with the network 430. More specifically, the interface 404 can include software supporting one or more communication protocols associated with communications. As such, the network 430 or the interface's hardware can be operable to communicate physical signals within and outside of the illustrated computer 402.

The computer 402 includes a processor 405. Although illustrated as a single processor 405 in FIG. 4, two or more processors 405 can be used according to particular needs, desires, or particular implementations of the computer 402 and the described functionality. Generally, the processor 405 can execute instructions and can manipulate data to perform the operations of the computer 402, including operations using algorithms, methods, functions, processes, flows, and procedures as described in the present disclosure.

The computer 402 also includes a database 406 that can hold data for the computer 402 and other components connected to the network 430 (whether illustrated or not). For example, database 406 can be an in-memory, conventional, or a database storing data consistent with the present disclosure. In some implementations, database 406 can be a combination of two or more different database types (for example, hybrid in-memory and conventional databases) according to particular needs, desires, or particular implementations of the computer 402 and the described functionality. Although illustrated as a single database 406 in FIG. 4, two or more databases (of the same, different, or combination of types) can be used according to particular needs, desires, or particular implementations of the computer 402 and the described functionality. While database 406 is illustrated as an internal component of the computer 402, in alternative implementations, database 406 can be external to the computer 402.

The computer 402 also includes a memory 407 that can hold data for the computer 402 or a combination of components connected to the network 430 (whether illustrated or not). Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 (of the same, different, or combination of types) can be used according to particular needs, desires, or particular implementations of the computer 402 and the described functionality. While memory 407 is illustrated as an internal component of the computer 402, in alternative implementations, memory 407 can be external to the computer 402.

The application 408 can be an algorithmic software engine providing functionality according to particular needs, desires, or particular implementations of the computer 402 and the described functionality. For example, application 408 can serve as one or more components, modules, or applications. Further, although illustrated as a single application 408, the application 408 can be implemented as multiple applications 408 on the computer 402. In addition, although illustrated as internal to the computer 402, in alternative implementations, the application 408 can be external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion and management circuits, including recharging, standby, and power management functionalities. In some implementations, the power supply 414 can include a power plug to allow the computer 402 to be plugged into a wall socket or a power source to, for example, power the computer 402 or recharge a rechargeable battery.

There can be any number of computers 402 associated with, or external to, a computer system containing computer 402, with each computer 402 communicating over network 430. Further, the terms "client," "user," and other appropriate terminology can be used interchangeably, as appropriate, without departing from the scope of the present disclosure.

Moreover, the present disclosure contemplates that many users can use one computer 402 and one user can use multiple computers 402.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems (for example, LINUX, UNIX, WINDOWS, MAC OS, ANDROID, or IOS).

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/-R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer via a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of an exchange file system can be done at the application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented in combination or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

Various modifications, alterations, and permutations of the disclosed implementations can be made and will be readily apparent to those of ordinary skill in the art. Further, the general principles defined may be applied to other implementations and applications without departing from the scope of the disclosure. In some instances, details unnecessary to obtain an understanding of the described subject matter may be omitted so as not to obscure one or more described implementations with unnecessary detail since such details are within the skill of one of ordinary skill in the art. The present disclosure is not intended to be limited to the described or illustrated implementations. The present disclosure is to be accorded the widest scope consistent with the described principles and features. For example, the term "real-time" can correspond to events that occur within a specified period of time, such as within one minute, within one second, or within milliseconds.

What is claimed is:

1. A computer-implemented method comprising:

determining, in real-time, values of drilling parameters of a drilling system drilling a wellbore;

calculating, based on the values of the drilling parameters, a cuttings concentration in an annulus of the wellbore (CCA);

calculating, based on the calculated CCA and a mud weight (MW) of a drilling fluid, an effective mud weight (MWeff) of the drilling fluid;

calculating, based on the effective mud weight, a slip velocity of the cuttings;

calculating, based on the slip velocity, a transport ratio (TR) of the cuttings; and controlling, based on the transport ratio, a component of the drilling system to adjust at least one of the drilling parameters.

2. The computer-implemented method of claim 1, wherein the effective mud weight is calculated using the equation: $(MW_{eff})=(MW*CCA)+MW$.

3. The computer-implemented method of claim 1, wherein the drilling parameters comprise:

a rate of penetration (ROP) of a drilling tool of the drilling system, a hole size of the wellbore, and a flow rate (GPM) of the drilling fluid.

4. The computer-implemented method of claim 3, wherein the CCA is calculated using the equation:

$$CCA = \frac{ROP * HoleSize^2}{810 * GPM}.$$

5. The computer-implemented method of claim 1, wherein the transport ratio is calculated using the equation:

$$TR = \left(1 - \frac{V_{sa} * W_c}{V_{ann} * ECD_{eff}}\right),$$

where Vsa is a slip velocity of cuttings, $W_c$ is a cuttings density, $V_{ann}$ is annular velocity, and $ECD_{eff}$ is an effective equivalent circulating density.

6. The computer-implemented method of claim 5, wherein $$V_{sa} = \frac{V_{s1} + V_{s2} + V_{sc}}{3},$$

where $V_{s1}$ is a cuttings velocity calculated based on effective viscosity, $V_{s2}$ is a cuttings velocity calculated based on apparent viscosity, and $V_{sc}$ is a cuttings velocity calculated based on the rate of penetration.

7. The computer-implemented method of claim 1, wherein controlling, based on the transport ratio, a component of the drilling system to adjust at least one of the drilling parameters comprises:

determining, based on the transport ratio, a rate of penetration for a drilling tool of the drilling system; and controlling the drilling tool such that the rate of penetration of the drilling tool is less than or equal to the rate of penetration.

8. A non-transitory computer-readable medium storing one or more instructions executable by a computer system to perform operations comprising:

determining, in real-time, values of drilling parameters of a drilling system drilling a wellbore;

calculating, based on the values of the drilling parameters, a cuttings concentration in an annulus of the wellbore (CCA);

calculating, based on the calculated CCA and a mud weight (MW) of a drilling fluid, an effective mud weight ($MW_{eff}$) of the drilling fluid;

calculating, based on the effective mud weight, a slip velocity of the cuttings;

calculating, based on the slip velocity, a transport ratio (TR) of the cuttings; and controlling, based on the transport ratio, a component of the drilling system to adjust at least one of the drilling parameters.

9. The non-transitory computer-readable medium of claim 8, wherein the effective mud weight is calculated using the equation: $(MW_{eff})=(MW*CCA)+MW$.

10. The non-transitory computer-readable medium of claim 8, wherein the drilling parameters comprise:

a rate of penetration (ROP) of a drilling tool of the drilling system, a hole size of the wellbore, and a flow rate (GPM) of the drilling fluid.

11. The non-transitory computer-readable medium of claim 10, wherein the CCA is calculated using the equation:

$$CCA = \frac{ROP * HoleSize^2}{810 * GPM}.$$

12. The non-transitory computer-readable medium of claim 8, wherein the transport ratio is calculated using the equation:

$$TR = \left(1 - \frac{V_{sa} * W_c}{V_{ann} * ECD_{eff}}\right),$$

where $V_{sa}$ is a slip velocity of cuttings, $W_c$ is a cuttings density, $V_{ann}$ is annular velocity, and $ECD_{eff}$ is an effective equivalent circulating density.

13. The non-transitory computer-readable medium of claim 12, wherein $$V_{sa} = \frac{V_{s1} + V_{s2} + V_{sc}}{3},$$

where $V_{s1}$ is a cuttings velocity calculated based on effective viscosity, $V_{s2}$ is a cuttings velocity calculated based on apparent viscosity, and $V_{sc}$ is a cuttings velocity calculated based on the rate of penetration.

14. The non-transitory computer-readable medium of claim 8, wherein controlling, based on the transport ratio, a component of the drilling system to adjust at least one of the drilling parameters comprises:

determining, based on the transport ratio, a rate of penetration for a drilling tool of the drilling system; and controlling the drilling tool such that the rate of penetration of the drilling tool is less than or equal to the rate of penetration.

15. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

determining, in real-time, values of drilling parameters of a drilling system drilling a wellbore;

calculating, based on the values of the drilling parameters, a cuttings concentration in an annulus of the wellbore (CCA);

calculating, based on the calculated CCA and a mud weight (MW) of a drilling fluid, an effective mud weight ($MW_{eff}$) of the drilling fluid;

calculating, based on the effective mud weight, a slip velocity of the cuttings; calculating, based on the slip velocity, a transport ratio (TR) of the cuttings; and controlling, based on the transport ratio, a component of the drilling system to adjust at least one of the drilling parameters.

16. The computer-implemented system of claim 15, wherein the effective mud weight is calculated using the equation: $(MW_{eff})=(MW*CCA)+MW$.

17. The computer-implemented system of claim 15, wherein the drilling parameters comprise:

a rate of penetration (ROP) of a drilling tool of the drilling system, a hole size of the wellbore, and a flow rate (GPM) of the drilling fluid.

18. The computer-implemented system of claim 17, wherein the CCA is calculated using the equation:

$$CCA = \frac{ROP * HoleSize^2}{810 * GPM},$$

where ROP is a rate of penetration of a drill bit, HoleSize is a hole size of the wellbore, and GPM is a flow rate of a mud pump of the drilling system.

* * * * *